United States Patent [19]

Elliott

[11] Patent Number: 4,506,475

[45] Date of Patent: Mar. 26, 1985

[54] HANGER FOR POTTED PLANTS

[76] Inventor: James J. Elliott, 700 Museum Dr., Charlotte, N.C. 28207

[21] Appl. No.: 493,340

[22] Filed: May 10, 1983

[51] Int. Cl.[3] ..... A01G 9/02

[52] U.S. Cl. ..... 47/67

[58] Field of Search ..... 47/67, 39; D6/113, 67, D6/39

[56] References Cited

U.S. PATENT DOCUMENTS

| | | | |
|---|---|---|---|
| D. 38,004 | 5/1906 | Wiesler | 47/67 X |
| D. 270,977 | 10/1983 | Kneale | D6/113 |
| 941,448 | 11/1909 | Haglund | 248/318 |
| 951,684 | 3/1910 | Gillespie | 47/67 |
| 1,326,086 | 12/1919 | Ormandy | 248/318 X |
| 1,484,403 | 2/1924 | Miller | 47/67 |
| 1,815,195 | 4/1929 | Favata, Jr. | 47/67 |
| 2,350,922 | 6/1944 | Planeta | 47/67 |
| 3,818,633 | 6/1974 | Sable | 47/1.2 |
| 3,854,242 | 12/1974 | Gladstein | 47/35 |
| 3,978,612 | 9/1976 | Young | 47/40 |

*Primary Examiner*—Robert A. Hafer
*Assistant Examiner*—Danton DeMille
*Attorney, Agent, or Firm*—Bell, Seltzer, Park & Gibson

[57] ABSTRACT

A hanger device is provided for suspending plant containers of various sizes, and which is particularly constructed for suspending relatively heavy containers, such as terra-cotta pots and their accompanying terra-cotta saucers. The hanger device includes a support base comprised of a circular ring and a plurality of spokes which radiate outwardly beyond the ring and terminate in a hook formation. Respective supporting chains are connected to the hook formations and extend upwardly therefrom. A circular retainer ring is positioned in spaced relation above the support base and inside of the chains, with the retainer ring having a diameter which is greater than that of the support base and sufficiently large to surround the plant container. The retainer ring can be adjustably positioned at various distances above the support base depending upon the height of the container.

3 Claims, 3 Drawing Figures

HANGER FOR POTTED PLANTS

FIELD AND BACKGROUND OF THE INVENTION

This invention relates to a hanger for potted plants, and more particularly to a hanger device for suspending plant containers of various sizes, and which is characterized by being particularly constructed for suspending relatively heavy containers, such as terra-cotta pots, and their accompanying saucer reservoirs.

While various types of hanging containers or "hanging baskets" have been produced heretofore, most hanging plant containers are suitable only for plants which are relatively small in size and light in weight. Typically, such plant containers utilize relatively lightweight materials, such as plastic.

There are many instances where it would be desirable to hang relatively large and heavy plants, or plants grown in relatively heavy containers such as terra-cotta pots and to allow them to sit in the accompanying terra-cotta saucers which act as water reservoirs essential for growing many plant species. Not only are the terra-cotta pots more pleasing in appearance than plastic in many applications, but many gardeners prefer terra-cotta pots over plastic because of the porosity of the container. However, because of the size and weight of terra-cotta pots, it has been inconvenient, if not impossible, to utilize them as a hanging container in many applications.

With the foregoing in mind, it is an important object of the present invention to provide a hanger device which is particularly constructed for suspending relatively heavy containers, such as terra-cotta pots and saucers, and which lends itself for use with containers of various sizes.

SUMMARY OF THE INVENTION

In accordance with the present invention, there is provided a hanger device which comprises a support base having an upper surface portion adapted for supporting a plant container thereon and which includes at least three connectors extending outwardly at substantially equally spaced apart locations around the perimeter of the support base, a respective supporting chain connected to each one of said at least three connectors and extending upwardly therefrom, means connecting together the upper ends of each of said chains of suspending the hanger device from a support, a retainer ring positioned in spaced relation above said support base and inside of said chains and having a central opening of such a diameter as to surround the plant container, said retainer ring including a plurality of fingers corresponding in number to the number of chains and projecting radially outwardly at substantially equally spaced apart locations about the circumference thereof, said fingers extending respectively into selected ones of the lengths of the chains for thereby adjustably supporting the retaining ring at a selected distance above the base depending upon the height of the container.

In the preferred embodiment illustrated and described more fully hereinafter, the supporting base is comprised of a circular ring and a plurality of spokes extending radially outwardly from the center of the ring, with the ring and the spokes defining an upper surface portion for supporting a plant container thereon, and with three of the spokes extending radially outwardly beyond the ring and terminating in a hook formation. The hook formations, more particularly, depend downwardly from the ring in the form of loops and serve to retain the chains during assembly and during use and also serve as feet for the support base when the hanger device is disassembled.

The fingers provided on the retainer ring project not only outwardly but also depend downwardly from the ring so that the fingers also serve as feet for supporting the retaining ring when the hanger device is disassembled. Thus, both the support base and the retainer ring can be used as trivets for a plant container when the plant is moved indoors during winter.

BRIEF DESCRIPTION OF THE DRAWINGS

Some of the features and advantages of the invention having been described, others will become apparent as the description proceeds, when taken in connection with the accompanying drawings, in which.

DESCRIPTION OF ILLUSTRATED EMBODIMENT

Figure 1:
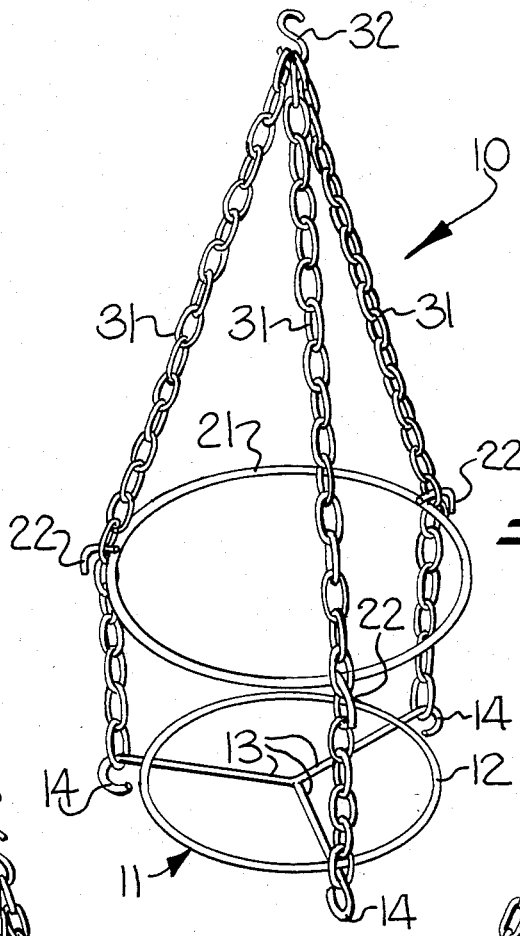
FIG. 1 is a perspective view showing a plant hanger in accordance with the invention used for hanging a container-grown plant.
Figure 2:
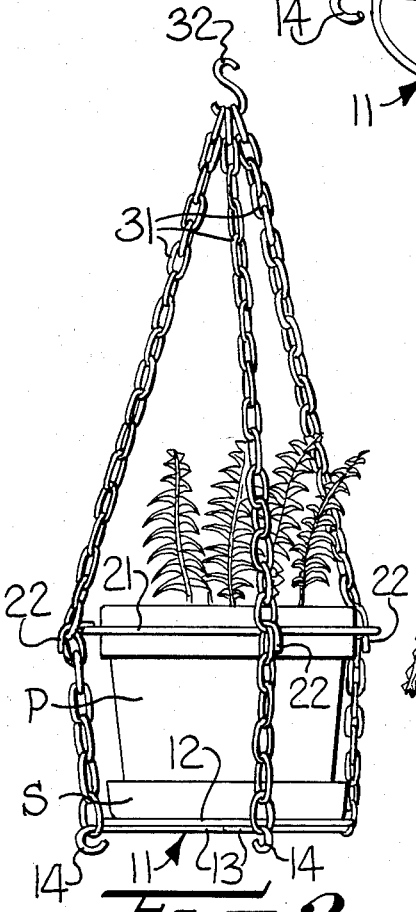
FIG. 2 is a side elevational view showing how the plant hanger may be used for supporting a container-grown plant.
Figure 3:
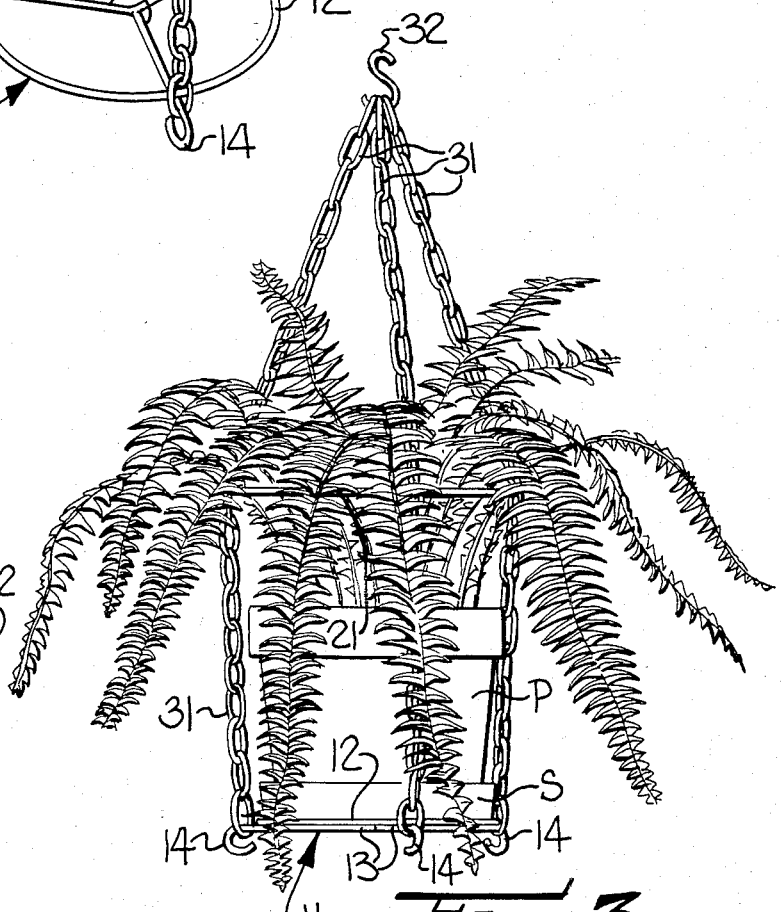
FIG. 3 is a view similar to FIG. 2 showing another way that the plant hanger may be used for supporting a container-grown plant.

Referring now more particularly to the drawings, a hanger device in accordance with the present invention is indicated generally by the reference character 10. As shown in FIGS. 2 and 3, the hanger device is used for supporting a terra-cotta saucer S in which there is positioned a relatively large terra-cotta pot P.

As illustrated, the hanger device comprises a support base 11 on which the saucer S is positioned, and a retainer ring 21 located above the support base and surrounding the pot P for retaining the pot P in position on the hanger device. Three chains 31 extend from the support base 11 to a common hook 32 for mounting the hanger device in suspended relation. The chains 31 also serve to mount the retainer ring at the desired location for retaining the pot.

Referring more particularly to the support base, it will be seen that the support base is comprised of a circular ring 12 formed of an iron rod generally circular in cross section, and three spokes 13 which are joined together at the center of the ring and extend radially outwardly therefrom, crossing the ring 12 and projecting outwardly therebeyond. The outer end portions of the spokes 13 are bent so as to depend downwardly from the ring and form hook formations, indicated by the reference character 14. The hook formations 14 serve for receiving and holding the lower end of the chain 31. The hook formations 14 also function as feet for the support base. When the hanger device is disassembled, the support base 11 can be used as a trivet for supporting a plant off of the floor to prevent damage to the floor or rug due to moisture from the plant container or its saucer.

The retainer ring 21 is of a generally circular configuration and includes three fingers 22, which are welded to the ring 21 and project radially outwardly and downwardly therefrom. The fingers pass through selected links in the chain 31 and serve for supporting the retainer ring 21 at a predetermined desired distance above the support base 11. The fingers 22 additionally serve as feet for the retainer ring 21 when the hanger device is disassembled. Thus, the retainer ring 21 can also be utilized as a trivet for supporting a pot in spaced relation off the floor.

As earlier noted, the fingers 22 allow the retainer ring 21 to be adjustably positioned at any desired distance above the support base 11 to thereby accommodate plant containers of various sizes. In FIG. 2, it will be seen that the ring 21 is located just below the rim of the pot P to prevent the pot from accidentally overturning and falling from the hanger device. When a plant has a great deal of foliage, such as the fern illustrated in FIG. 3, the retainer ring 21 may be positioned above the upper rim of the pot P where it serves not only for supporting the pot, but for supporting the foliage in a graceful upwardly spreading arrangement.

The elements of the support base and the ring are formed from iron rod and are welded together so as to be capable of bearing the weight of relatively heavy containers.

In the drawings and specification, there is set forth a preferred embodiment of the invention, and while specific terms are employed to aid in understanding the invention, they are used in a generic and descriptive sense only and not for purposes of limitation.

That which is claimed is:

1. A hanger device for suspending plant containers of various sizes, and characterized by being particularly constructed for suspending relatively heavy plant containers, such as terra-cotta pots and their accompanying terra-cotta saucers, said hanger device comprising a support base comprised of a circular ring and a plurality of spokes, at least three in number, extending radially outwardly from the center of the ring, said ring and said spokes defining an upper surface portion for supporting a plant container thereon, at least three of said spokes extending radially outwardly beyond the perimeter of said circular ring and terminating in a hook formation depending downwardly from said ring in the form of a loop such that the respective hook formations collectively serve as feet for said support base when the hanger device is disassembled, a respective supporting chain connected to each one of said hook formations and extending upwardly therefrom, each chain being comprised of a series of interconnected links, means connecting together the upper ends of each of said chains for suspending the hanger device from a support, a circular retainer ring removably and adjustably positioned in spaced relation above said support base and inside of said chains, said retainer ring having a diameter larger than that of said support base and adapted for surrounding a plant container, and said retainer ring including three fingers projecting radially outwardly at substantially equally spaced apart locations about the circumference thereof, said fingers extending respectively into selected ones of the links of said chains with said fingers being removable from said chains for thereby adjustably supporting the retainer ring at a selected distance above the base depending upon the height of the container.

2. A hanger device as set forth in claim 1 wherein said spokes are three in number.

3. A hanging plant container assembly comprising a terra-cotta saucer, a terra-cotta pot positioned in said saucer, a support base positioned beneath said saucer, said support base comprising a circular ring and a plurality of spokes extending radially outwardly from the center of the ring, said ring and said spokes defining an upper surface portion for supporting said saucer thereon, and three of said spokes extending radially outwardly beyond said ring and terminating in a hook formation depending downwardly from said ring in the form of a loop such that the respective hook formations collectively serve as feet for said support base when the hanger device is disassembled, a respective supporting chain comprised of a series of interconnected links connected to each one of said three hook formations and extending upwardly therefrom to a point located above said pot, means connecting together the upper ends of each of said chains for thereby suspending the pot and saucer on said support base, a circular retainer ring removably and adjustably positioned in spaced relation above said support base and inside of said chains and surrounding said pot, said retainer ring including three fingers projecting radially outwardly at substantially equally spaced apart locations about the circumference thereof, said fingers extending respectively into selected ones of the links of said chains with said fingers being removable from said chains for thereby adjustably supporting the retainer ring at a selected distance above the base depending upon the height of the pot.

* * * * *